US008122805B2

(12) United States Patent
Liu

(10) Patent No.: US 8,122,805 B2
(45) Date of Patent: Feb. 28, 2012

(54) PAPER PROCESSING TOOL WITH THREE-LEVER ACTUATION

(75) Inventor: Rong Liu, Vernon Hills, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 401 days.

(21) Appl. No.: 11/954,605

(22) Filed: Dec. 12, 2007

(65) Prior Publication Data

US 2009/0151532 A1 Jun. 18, 2009

(51) Int. Cl.

| | |
|---|---|
| ***B26D 5/08*** | (2006.01) |
| ***B26D 5/18*** | (2006.01) |
| ***B26F 1/14*** | (2006.01) |
| ***B26F 1/00*** | (2006.01) |
| ***B26B 19/02*** | (2006.01) |
| ***B26B 19/12*** | (2006.01) |

(52) U.S. Cl. ..... 83/687; 83/605; 83/633; 83/630; 83/684; 30/218; 30/363

(58) Field of Classification Search ..... 83/618, 83/633–634, 687, 605, 691, 167, 683, 684, 83/620, 627, 630, 589; 30/353, 363, 215, 30/204, 216–220, 181, 183, 189

See application file for complete search history.

(56) References Cited

U.S. PATENT DOCUMENTS

| | | | | |
|---|---|---|---|---|
| 41,861 | A | 3/1864 | Renfrew | |
| 332,666 | A | 12/1885 | Laney | |
| 383,200 | A | 5/1888 | Weber et al. | |
| 1,054,132 | A | 2/1913 | Miner | |
| 1,615,020 | A | 1/1927 | Loehr | |
| 1,728,475 | A | 9/1929 | Cavill | |
| 1,962,874 | A | 6/1934 | Fridolin | |
| 1,998,328 | A | 4/1935 | McKinnie | |
| 2,132,047 | A | 10/1938 | Rix | |
| 2,278,288 | A * | 3/1942 | Sadler | 83/620 |

(Continued)

FOREIGN PATENT DOCUMENTS

AU 2007100602 A4 8/2007

(Continued)

OTHER PUBLICATIONS

International Search Report and Written Opinion for corresponding International Application No. PCT/US07/87157 mailed on Jul. 31, 2008.

*Primary Examiner* — Ghassem Alie
*Assistant Examiner* — Bharat C Patel
(74) *Attorney, Agent, or Firm* — Michael Best & Friedrich LLP

(57) ABSTRACT

A paper processing tool includes a base having a receiving area for selectively receiving a sheet of paper. The tool further includes a first lever having a handle portion, the first lever being pivotable relative to the base about a first axis. An intermediate lever is pivotable relative to the base about a second axis in response to movement of the first lever. At least one cutting element is arranged along a cutting plane, the at least one cutting element being configured to selectively engage the sheet of paper. A drive lever is actuable by the intermediate lever to move the at least one cutting element relative to the base. The drive lever is pivotable relative to the base about a third axis parallel to the cutting plane.

12 Claims, 16 Drawing Sheets

U.S. PATENT DOCUMENTS 2,326,540 A 8/1943 Krantz
2,382,523 A 8/1945 Unger
2,474,344 A 6/1949 Carpenter
2,482,218 A 9/1949 Segal
2,671,215 A 3/1954 Abrams
2,814,346 A 11/1957 Jauss
2,962,178 A 11/1960 Exline
3,087,366 A 4/1963 Stults
3,120,778 A 2/1964 Brye
3,181,408 A 5/1965 Richards
3,263,548 A 8/1966 Kobler et al.
3,472,101 A 10/1969 Tanaka
3,590,484 A 7/1971 Walsh
3,735,655 A 5/1973 Dedona et al.
3,748,936 A 7/1973 Minasy
3,756,625 A 9/1973 Abilgaard et al.
3,793,660 A 2/1974 Sims
3,821,890 A 7/1974 Dewey
3,826,168 A 7/1974 Groswith, III et al.
3,842,650 A * 10/1974 Hartmeister ..... 72/409.01
3,921,487 A 11/1975 Otsuka et al.
4,019,415 A 4/1977 Wich
4,036,088 A 7/1977 Ruskin
4,077,288 A 3/1978 Holland
4,126,260 A 11/1978 Mickelsson
4,166,404 A * 9/1979 Almog ..... 83/167
4,173,162 A 11/1979 Shaughnessy
4,184,396 A 1/1980 Hafner
4,294,152 A 10/1981 Land
4,301,723 A 11/1981 Borzym
4,466,322 A 8/1984 Mori
4,499,805 A 2/1985 Mori
4,611,520 A 9/1986 Terracciano
4,645,399 A 2/1987 Scharer
4,656,907 A 4/1987 Hymmen
4,664,004 A 5/1987 Randall
4,706,533 A 11/1987 Giulie
4,713,995 A 12/1987 Davi
4,757,733 A 7/1988 Barlow
4,779,785 A 10/1988 Amagaya
4,833,958 A 5/1989 Abildgaard et al.
4,987,811 A 1/1991 Ikarashi et al.
4,993,291 A 2/1991 Sopko
5,007,782 A 4/1991 Groswith, III et al.
5,040,441 A 8/1991 Tamura
5,044,242 A 9/1991 Chiang
5,143,502 A 9/1992 Kaufmann et al.
5,163,350 A * 11/1992 Groswith et al. ..... 83/549
5,174,794 A 12/1992 Brownlee et al.
5,247,863 A 9/1993 Cohen
5,273,387 A 12/1993 Groswith, III et al.
5,335,839 A 8/1994 Fealey
5,377,415 A * 1/1995 Gibson ..... 30/363
5,431,519 A 7/1995 Baumann
5,492,261 A 2/1996 Chi
5,494,364 A 2/1996 Murakami et al.
5,497,932 A 3/1996 Brewer et al.
5,639,007 A 6/1997 Nakamura
5,664,473 A 9/1997 Huang
5,664,722 A 9/1997 Marks
5,683,218 A 11/1997 Mori
5,740,712 A 4/1998 Watkins et al.
5,758,813 A 6/1998 Kikuchi et al.
5,765,742 A 6/1998 Marks
5,778,750 A 7/1998 Drzewiecki et al.
5,890,642 A 4/1999 Sato
5,979,736 A 11/1999 Edeholt
6,109,155 A 8/2000 Huang
6,145,728 A 11/2000 Marks
6,179,193 B1 1/2001 Nagai
6,547,119 B2 4/2003 Huang
6,550,661 B2 4/2003 Aoki
6,688,199 B2 2/2004 Godston et al.
6,776,321 B2 8/2004 Jairam et al.
6,789,593 B1 9/2004 Aono et al.
6,789,719 B2 9/2004 Shor
6,918,525 B2 7/2005 Marks
6,966,479 B2 11/2005 Tanaka et al.
6,997,092 B2 * 2/2006 Lin ..... 83/588
7,118,019 B2 10/2006 Marks
7,124,924 B2 10/2006 Marks
7,178,709 B2 2/2007 Marks
7,216,791 B1 5/2007 Marks
7,299,960 B1 11/2007 Marks
7,395,955 B2 7/2008 Zins et al.
7,610,838 B2 11/2009 Kent et al.
2002/0005427 A1 1/2002 Aoki
2002/0020272 A1 2/2002 Godston et al.
2003/0010176 A1 1/2003 Chiang
2003/0047581 A1 3/2003 Tanaka et al.
2003/0155400 A1 8/2003 Jairam et al.
2004/0069110 A1 4/2004 Godston et al.
2005/0229765 A1 10/2005 Watanabe
2006/0138192 A1 6/2006 Matsukawa
2007/0044618 A1 3/2007 Marks
2007/0044623 A1 3/2007 Marks
2007/0044624 A1 3/2007 Marks
2007/0057011 A1 3/2007 Kandasamy et al.
2007/0057012 A1 3/2007 Kandasamy et al.
2007/0107576 A1 5/2007 Chen
2007/0125823 A1 6/2007 Marks
2007/0145094 A1 6/2007 Chou
2007/0158384 A1 7/2007 Zins et al.
2007/0169603 A1 7/2007 Marks
2007/0199424 A1 8/2007 Marks
2007/0199971 A1 8/2007 Chen
2007/0221699 A1 9/2007 Hsu
2007/0227286 A1 10/2007 Kandasamy
2007/0266836 A1 11/2007 Marks
2007/0267472 A1 11/2007 Marks
2008/0236353 A1 10/2008 Kent et al.

FOREIGN PATENT DOCUMENTS

CH 252144 9/1948
DE 1042530 11/1958
EP 0283676 9/1988
EP 0385034 9/1990
EP 0761392 3/1997
FR 994186 11/1951
JP 4300198 10/1992
JP 8155898 6/1996
WO 2007030712 3/2007
WO 2007055297 A1 5/2007
WO 2007055298 A1 5/2007
WO 2007055398 A1 5/2007
WO 2007058337 A1 5/2007
WO 2007087309 A2 8/2007

* cited by examiner

PAPER PROCESSING TOOL WITH THREE-LEVER ACTUATION

BACKGROUND

The present invention relates to paper processing tools often used in an office environment for trimming and punching paper or other sheet material. Such paper processing tools known in the prior art are either compact with very little mechanical advantage or alternately are provided with undesirable bulk and/or complexity in order to obtain a greater mechanical advantage, which makes the working operation easier for the user, but increases the amount of desktop/storage space needed and/or increases the number of parts along with manufacturing and assembly costs.

SUMMARY

In one embodiment, the invention provides a paper processing tool including a base having a receiving area for selectively receiving a sheet of paper. The tool further includes a first lever having a handle portion, the first lever being pivotable relative to the base about a first axis. An intermediate lever is pivotable relative to the base about a second axis in response to movement of the first lever. At least one cutting element is arranged along a cutting plane, the at least one cutting element being configured to selectively engage the sheet of paper. A drive lever is actuable by the intermediate lever to move the at least one cutting element relative to the base. The drive lever is pivotable relative to the base about a third axis parallel to the cutting plane.

In another embodiment, the invention provides a paper processing tool including a base defining a sheet insertion area. At least one cutting element is arranged within a cutting plane and movable relative to the base to perform a cutting operation. A first lever is pivotably coupled to the base and rotatable about a first axis, the first lever including a handle portion remote from the first axis. An intermediate lever is pivotably coupled to the base and rotatable about a second axis, the intermediate lever being actuable by the first lever. The first and second axes are positioned on opposite sides of the cutting plane. A drive lever is coupled to the intermediate lever and rotatable about a third axis parallel to the first and second axes. The drive lever is actuable by the intermediate lever to drive the at least one cutting element.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
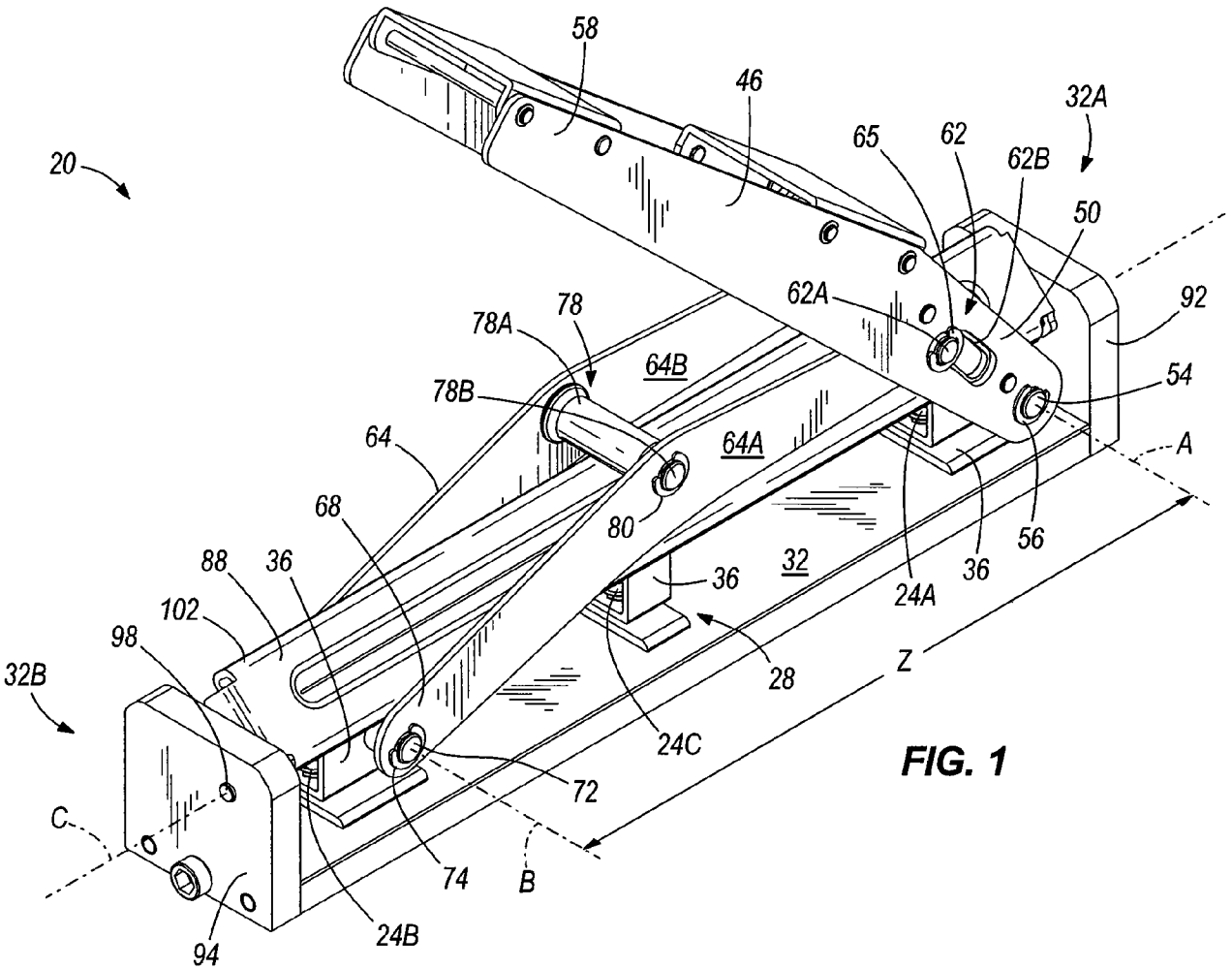
FIG. 1 is a perspective view of a paper processing tool embodying the invention.
Figure 2:
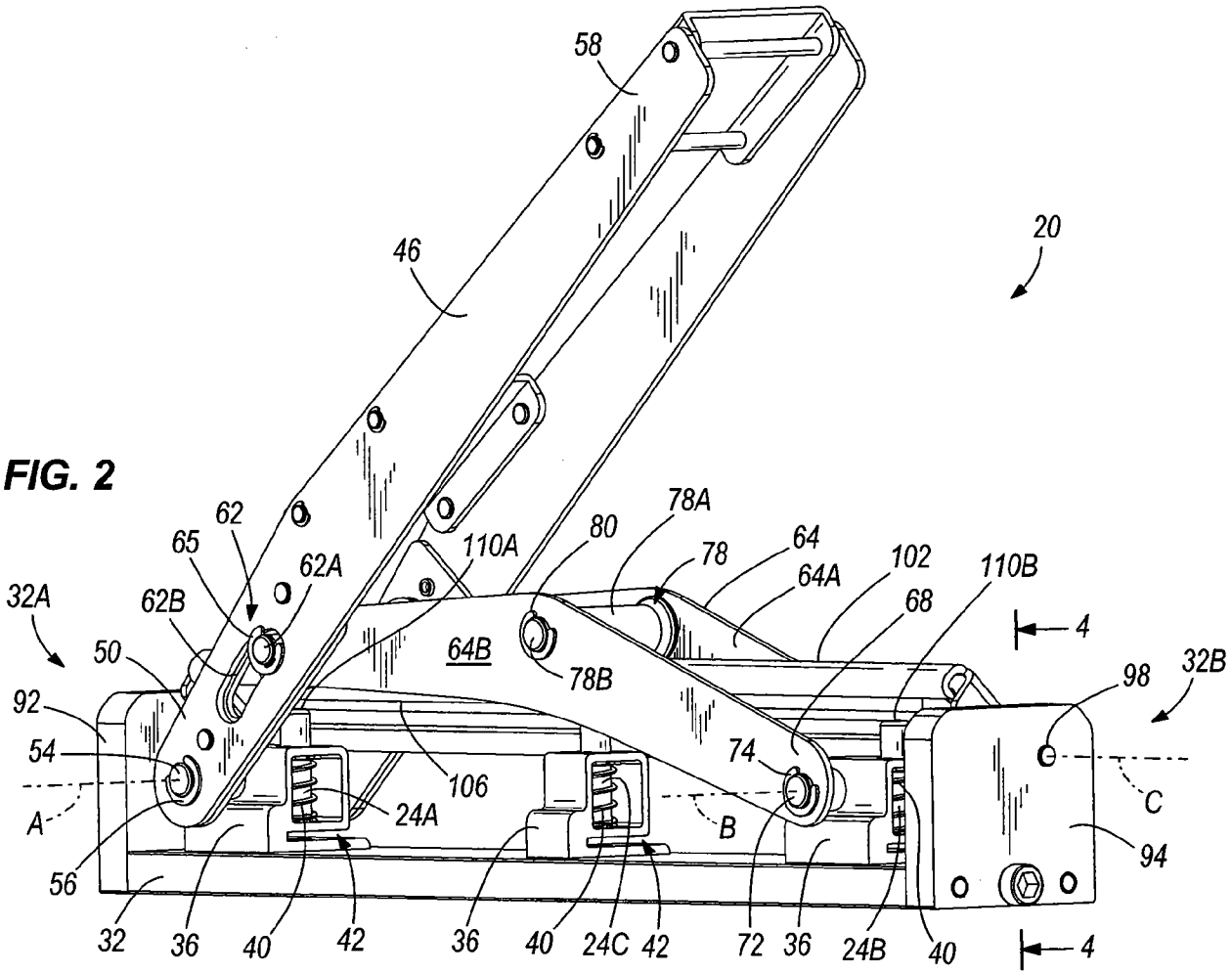
FIG. 2 is another perspective view of the paper processing tool of FIG. 1.
Figure 3:
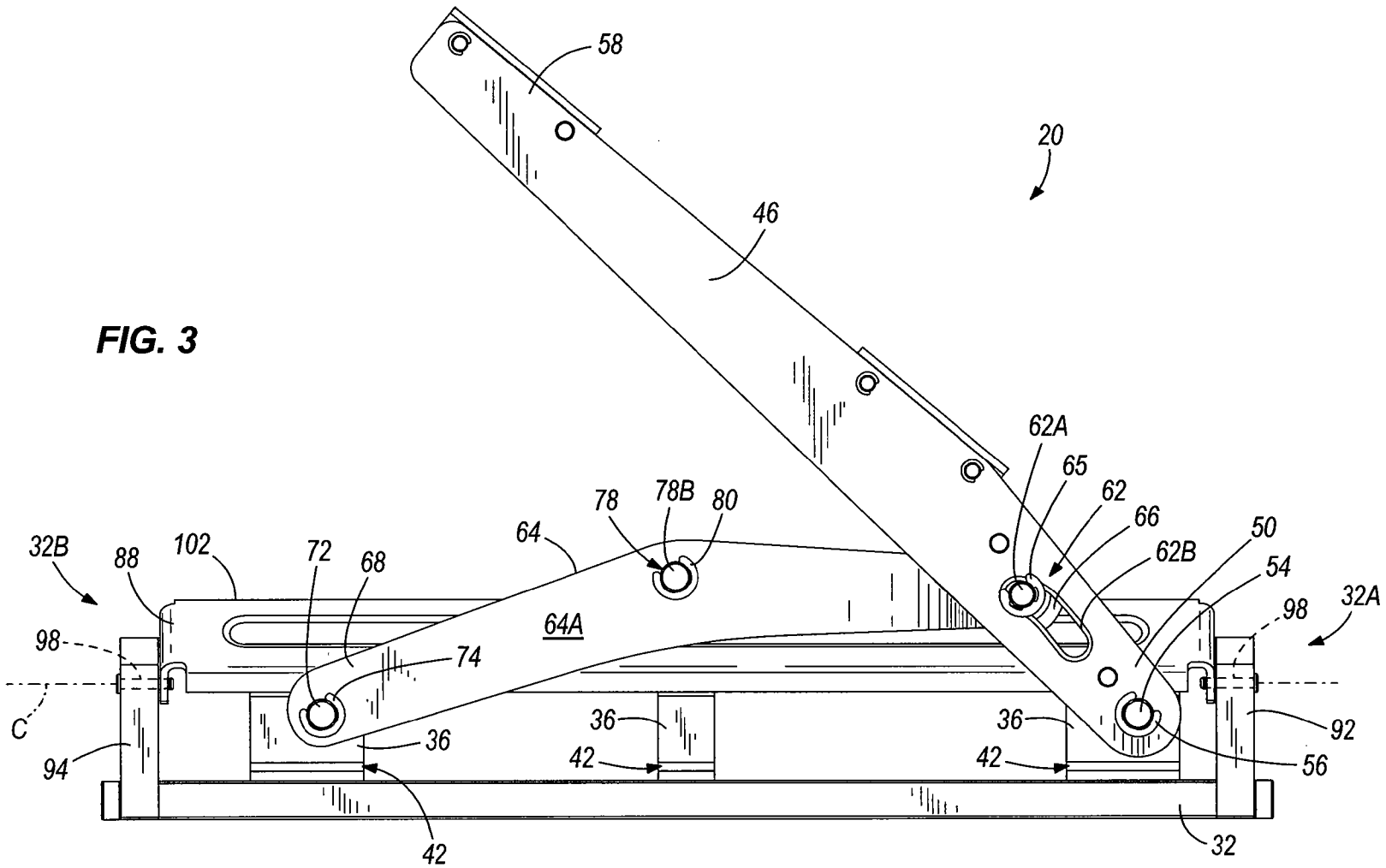
FIG. 3 is a front view of the paper processing tool of FIG. 1.

FIGS. 1 and 2 illustrate a paper processing tool 20 operable to perform an operation on one or more sheets of paper or other material. The illustrated paper processing tool 20 is a three-hole punch having a set of punch pins 24A, 24B, 24C positioned adjacent a sheet insertion area 28 and spaced equal distances W apart. The paper processing tool 20 may alternately take the form of another type of apparatus for punching (having more or less than three punch pins), trimming, cutting, etc. In a punching apparatus, tool elements may be similar to the punch pins 24A-C shown, and in other types of apparatuses, alternate types of tool elements may be provided. In the illustrated embodiment, the paper processing tool 20 is particularly adapted for manual operation by a human hand. In other embodiments, the paper processing tool 20 may be configured for automated actuation.

The paper processing tool 20 includes a base 32 having a first end 32A and a second end 32B opposite the first end 32A. Each of the punch pins 24A-C is supported for reciprocable movement relative to the base 32 along a respective axis D1, D2, D3. The punch pins 24A-C are substantially aligned, such that a cutting plane D4 (FIG. 7) contains each of the punch pin axes D1, D2, D3. The base 32 includes a punch frame or housing 36 for each punch pin 24A-C which mounts the punch pins 24A-C to the base 32 and guides the movement of the punch pins 24A-C. One or more of the punch frames 36 may be movable within the cutting plane D4 to vary the spacing between the punch pins 24A-C. A biasing element such as a coil spring 40 is engaged with each of the punch pins 24A-C and with the corresponding punch frame 36. Each punch frame 36 defines an insertion slot 42 positioned along the sheet insertion area 28. The coil springs 40 bias the punch pins 24A-C generally upward out of the insertion slots 42.

The paper processing tool 20 further includes a first lever 46. The first lever 46 is an input member of the paper processing tool 20 and as such, is configured to receive an input force incident on the paper processing tool 20. The first lever 46 includes an attachment portion 50 mounted to the base 32, and the first lever 46 is pivotable relative to the base 32 about a first axis A. The first axis A is located adjacent the first end 32A of the base 32. The first axis A is defined by an axle or pin 54 and by coaxial holes in the attachment portion 50 and the punch frame 36 nearest the first end 32A of the base 32. The pin 54 is axially positioned by a retaining element such as an E-ring 56 on each end. The first lever 46 includes a handle portion 58 remote from the attachment portion 50 and the first axis A. The handle portion 58 is configured to receive a manual input from a user's hand, although the first lever 46 may be actuated in an automated manner in some embodiments.

A sliding joint 62 is provided between the first lever 46 and an intermediate lever 64. The sliding joint 62 includes a pin 62A movable with the intermediate lever 64 and a slot 62B in the first lever 46. The pin 62A is axially positioned by a retaining element such as an E-ring 65 on each end. The sliding joint 62 is located adjacent the attachment portion 50 on the first lever 46. On the intermediate lever 64, the sliding joint 62 is located adjacent a first end 66, which is opposite a second end 68 of the intermediate lever 64, where the intermediate lever 64 is coupled to the base 32. The intermediate lever 64 is pivotable relative to the base 32 about a second axis B. The second axis B is located adjacent the second end 32B of the base 32. The second axis B is defined by an axle or pin 72 and by coaxial holes in the second end 68 of the intermediate lever 64 and the punch frame 36 nearest the second end 32B of the base 32. The pin 72 is axially positioned by a retaining element such as an E-ring 74 on each end. The intermediate lever 64 is a transmission member configured to receive a force from the first lever 46 and transmit an equal or greater force to the punch pins 24A-C through at least one additional transmission member.

The illustrated intermediate lever 64 includes two spaced-apart parallel links 64A, 64B and a drive member such as a drive pin 78 extending between the links 64A, 64B at a location between the first and second ends 66, 68. In the illustrated embodiment, the drive pin 78 is substantially centered between the first and second ends 66, 68 of the intermediate lever 64. The drive pin 78 is axially positioned relative to the links 64A, 64B by a retaining element such as an E-ring 80 on each end. In the illustrated embodiment, the drive pin 78 includes a roller 78A having a rounded or cylindrical drive surface 84 configured to engage a drive lever 88. In some embodiments, the roller 78A spins on a shaft 78B of the drive pin 78, such that the roller 78A is pivotably coupled to the links 64A, 64B.

The drive lever 88 extends between the first end 32A and the second end 32B of the base 32. In the illustrated embodiment, the drive lever 88 is coupled to a first end plate 92 of the base 32 at the first end 32A and to a second end plate 94 of the base 32 at the second end 32B. The drive lever 88 is positioned relative to the base 32 by a pin 98 at each of the first and second end plates 92, 94 or by a single shaft (not shown). The pins 98 define a third axis C about which the drive lever 88 is pivotable relative to the base 32. The third axis C extends between the first and second ends 32A, 32B of the base and is substantially perpendicular to both of the first and second axes A, B, which are substantially parallel with each other. The drive lever 88 is configured to engage and actuate the punch pins 24A-C as described in further detail below.

Figure 4:
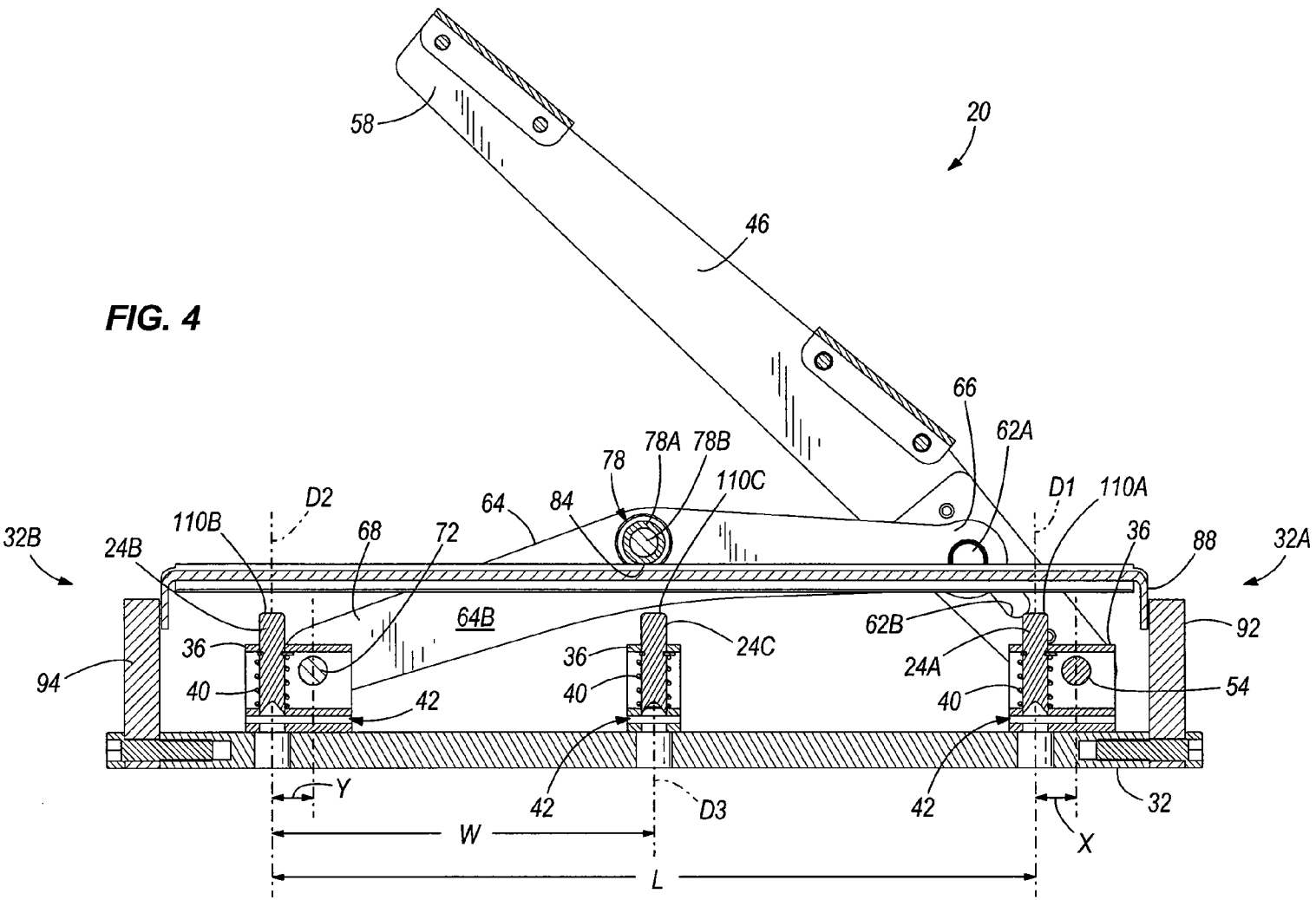
FIG. 4 is a cross-section view of the paper processing tool of FIG. 1 taken along line 4-4 of FIG. 3.
Figure 5:
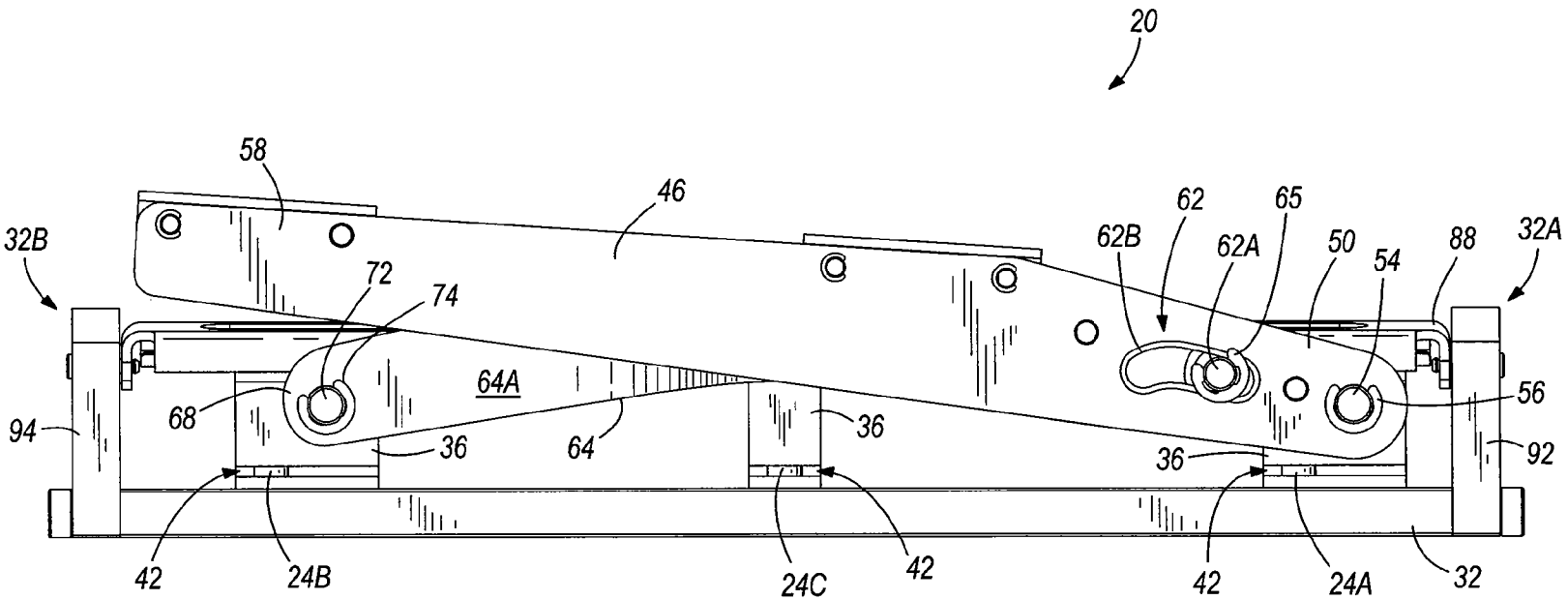
FIG. 5 is a front view of the paper processing tool of FIG. 1 in an actuated operating condition.
Figure 6:
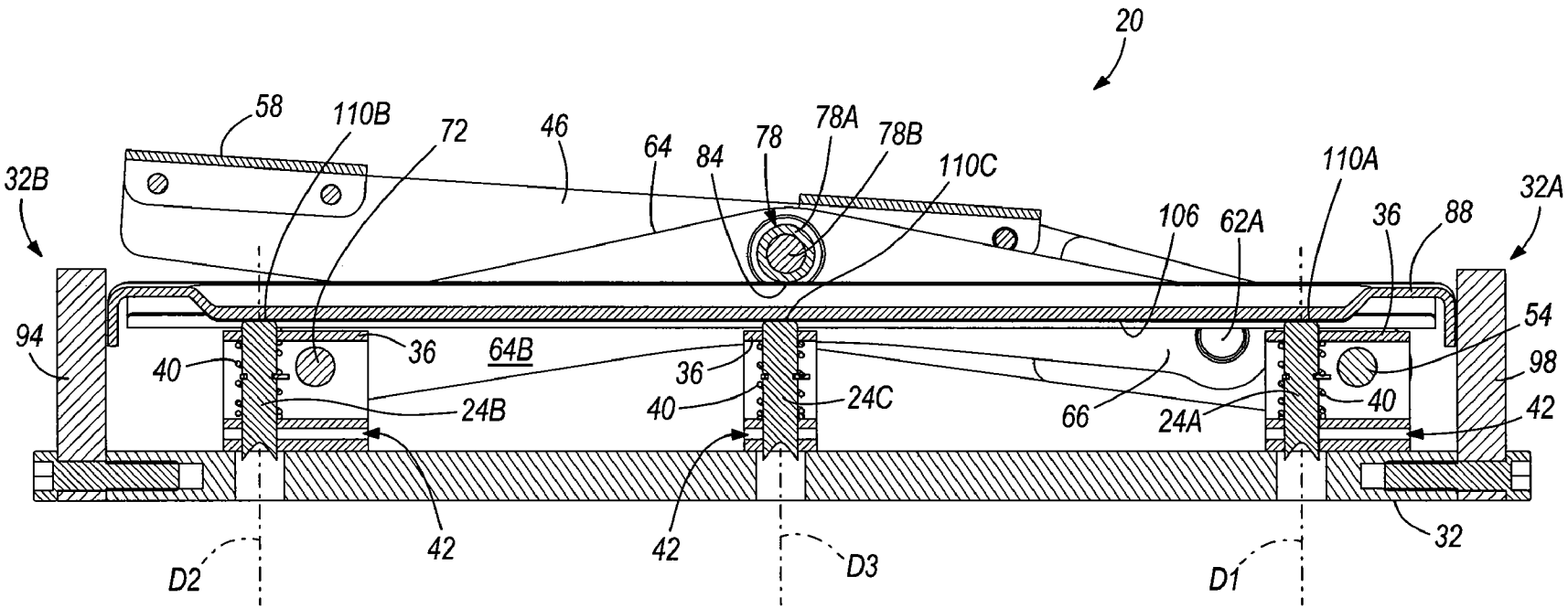
FIG. 6 is a cross-section view of the paper processing tool of FIG. 1 taken along line 6-6 of FIG. 5, the paper processing tool being in the actuated operating condition.

As shown in at least FIGS. 4 and 6, the drive lever 88 includes a first cam surface 102 engageable with the intermediate lever 64 and a second cam surface 106 (FIG. 6) engageable with the punch pins 24A-C. The first cam surface 102 includes a rounded profile configured to be engaged and driven by the drive surface 84 of the drive pin 78. The two rounded surfaces (i.e., the drive surface 84 of the drive pin 78 and the first cam surface 102) define a sliding cam engagement or sliding joint between the intermediate lever 64 and the drive lever 88. In some embodiments, the drive pin 78 rolls on the drive lever 88 or an additional rolling member (not shown) is provided between the drive pin 78 and the drive lever 88 so that a rolling cam engagement or rolling joint is provided. The second cam surface 106 of the drive lever 88 is configured to engage an upper drive surface 110A-C of each of the punch pins 24A-C (FIGS. 4 and 6). The second cam surface 106 includes a rounded profile engaged with the upper drive surfaces 110A-C, which are substantially flat in the illustrated embodiment. The second cam surface 106 of the drive lever 88 actuates all three punch pins 24A-C for synchronized movement of the punch pins 24A-C (within the cutting plane D4) towards and into engagement with a sheet object 114 (FIG. 7) in the insertion area 28.

In other embodiments, more or fewer than three punch pins similar to the punch pins 24A-C are provided, and the second cam surface 106 of the drive lever 88 engages the punch pins 24A-C for synchronized movement thereof. Furthermore, the punch pins 24A-C may be actuated sequentially by the drive lever 88. In yet other embodiments, the paper processing tool 20 is provided with one or more alternate tool elements instead of the punch pins 24A-C as illustrated. For example, a planar cutting or trimming blade (having a linear or non-linear profile) may be actuable by the drive lever 88 in a manner similar to that described above with respect to the punch pins 24A-C.

In operation, the sheet object 114 to be processed (e.g., cut, trimmed, punched) is inserted into the insertion area 28 along an insertion direction perpendicular to the cutting plane D4. A force is then applied to the handle portion 58 of the first lever 46. The first lever 46 rotates relative to the base 32 about the first axis A. The force applied to the first lever 46 is multiplied as it is transferred to the intermediate lever 64 via the sliding joint 62. During transfer between the first lever 46 and the intermediate lever 64, the handle portion 58 moves towards the base 32 and the pin 62A slides within the slot 62B. As the pin 62A slides in the slot 62B toward the first axis A, the mechanical advantage or force multiplication between the first lever 46 and the intermediate lever 64 is increased due to the increased lever arm distance between the handle portion 58 and the pin 62A. The sliding joint 62 provides a variable mechanical advantage by allowing the point of contact between the first lever 46 and the intermediate lever 64 (defined by the point on the slot 62B that is in driving contact with the pin 62A) to move relative to the first axis A.

As force is transmitted from the first lever 46 to the intermediate lever 64 through the sliding joint 62, the first end 66 of the intermediate lever 64 moves towards the base 32 as the intermediate lever 64 rotates about the second axis B. The drive pin 78 moves towards the base 32 such that the drive surface 84 engages the first cam surface 102 of the drive lever 88. As the intermediate lever 64 rotates about the second axis B, the drive pin 78 drives the drive lever 88 to rotate about the third axis C. Some amount of sliding occurs between the cylindrical drive surface 84 of the drive pin 78 and the rounded profile of the first cam surface 102 as the drive lever 88 is rotated generally downward towards the base 32. Alternately or in addition, sliding may occur between the drive pin 78 and each of the first and second links 64A, 64B of the intermediate lever 64. In some embodiments, some amount of rolling occurs between the drive pin 78 and the drive lever 88, whether directly between the drive surface 84 and the first cam surface 102 or alternately, through an additional roller (not shown) therebetween.

As the drive lever 88 rotates towards the base 32 under force from the intermediate lever 64, the second cam surface 106 of the drive lever 88 actuates the punch pins 24A-C to drive the punch pins 24A-C along their respective axes D1, D2, D3. In the illustrated embodiment, the punch pins 24A-C are actuated synchronously from fully inoperative positions (FIG. 4) outside of the insertion slots 42 to fully operative positions (FIG. 6) in which the punch pins 24A-C extend entirely through the insertion slots 42. In some embodiments, the punch pins 24A-C are actuated asynchronously. The punch pins 24A-C remain in the cutting plane D4 (FIG. 7) at all times.

In order to generate a large mechanical advantage for performing the desired action on the sheet object 114 within an efficient and small size or "foot print" (i.e., the area of the base 32), the paper processing tool 20 includes a specific arrangement with respect to the levers 46, 64, 88 and the respective axes of rotation A, B, C. The first axis A is positioned just outside the punch pin 24A adjacent the first end 32A of the base 32. Specifically, the first axis A is positioned a distance X between about 9 percent and about 12 percent of the distance W (between adjacent punch pins 24A-C) from the first punch pin 24A. In the illustrated embodiment, the first axis A is positioned a distance X that is about 10 percent of the distance W from the first punch pin 24A. Furthermore, the second axis B is positioned just within the punch pin 24B adjacent the second end 32B of the base 32. Specifically, the second axis B is positioned a distance Y between about 9 percent and about 12 percent of the distance W from the second punch pin 24B. In the illustrated embodiment, the second axis B is positioned a distance Y that is about 10 percent of the distance W from the second punch pin 24B. The first and second axes A, B are fixed pivots, which are fixed relative to the base 32. As mentioned above, the point of contact between the slot 62B and the pin 62A of the sliding joint 62 is a variable, non-fixed pivot that increases the mechanical advantage of the paper processing tool 20 during the downward stroke of the first lever 46. The paper processing tool 20 has a mechanical advantage of at least 15 between the force applied at the first lever 46 and the force applied to the sheet object 114 by the punch pins 24A-C. The particular arrangement illustrated and described above generates a mechanical advantage of about 20 between the force applied at the first lever 46 and the force applied to the sheet object 114 by the punch pins 24A-C.

Figure 7:
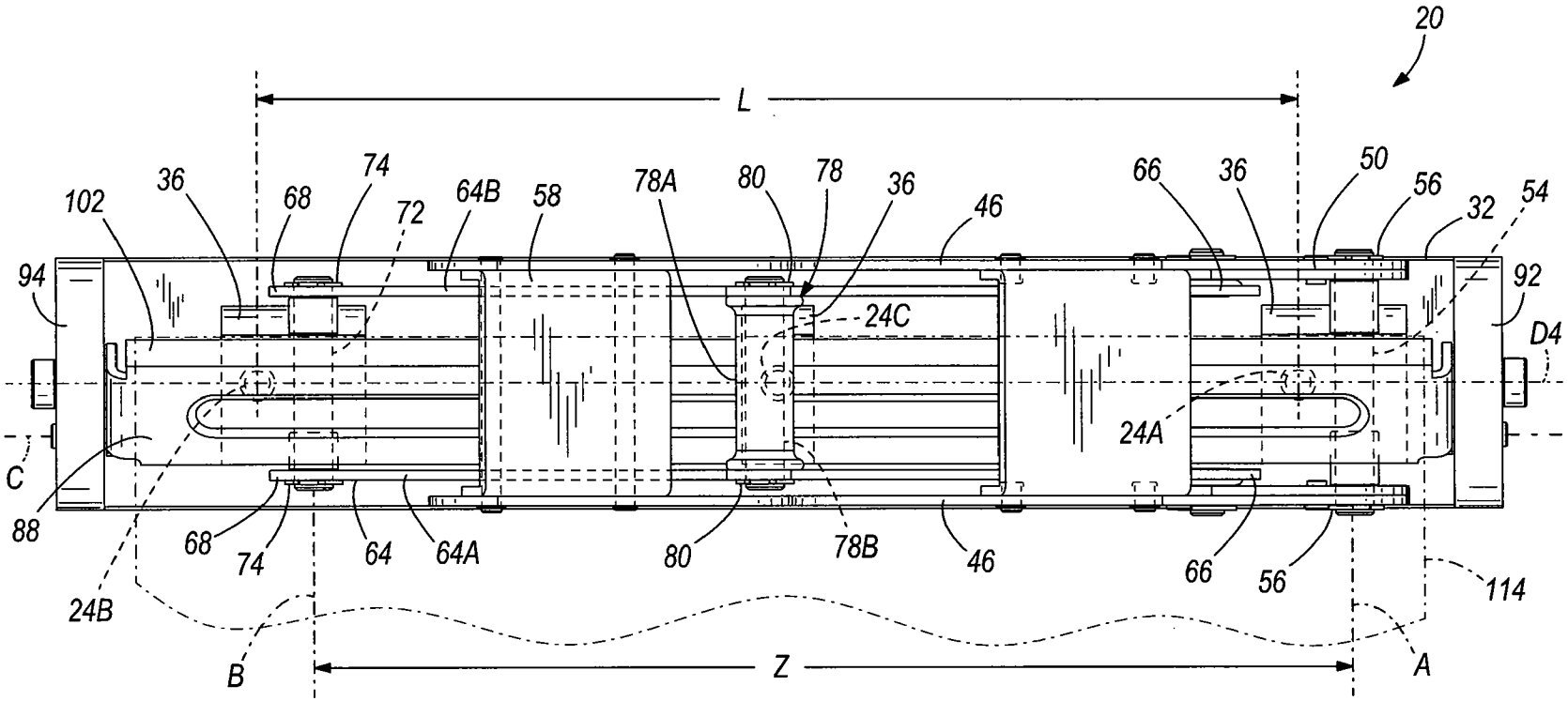
FIG. 7 is a top view of the paper processing tool of FIG. 1, having a sheet object inserted therein.
Figure 8:
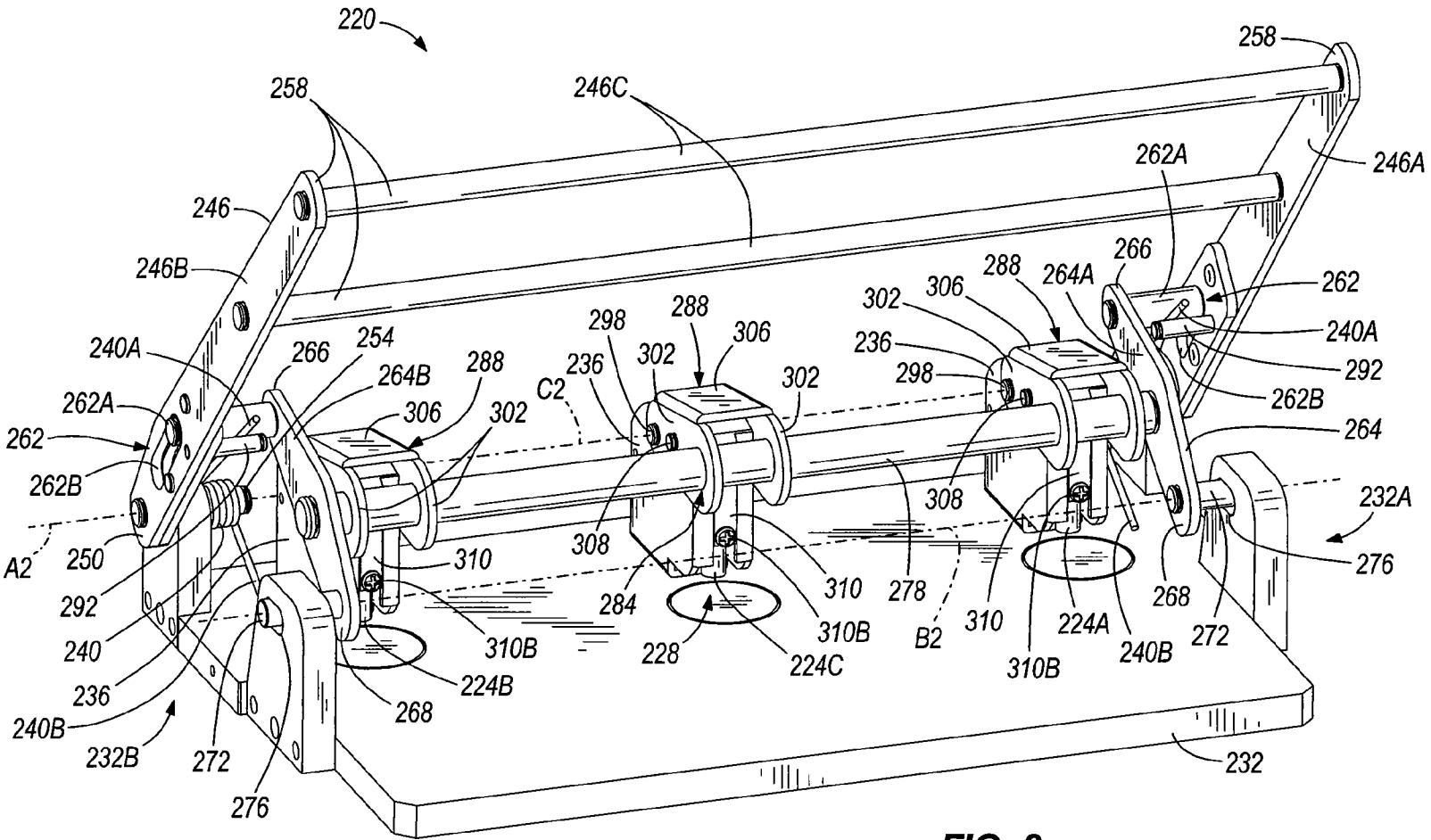
FIG. 8 is a perspective view of a second paper processing tool embodying the invention.
Figure 9:
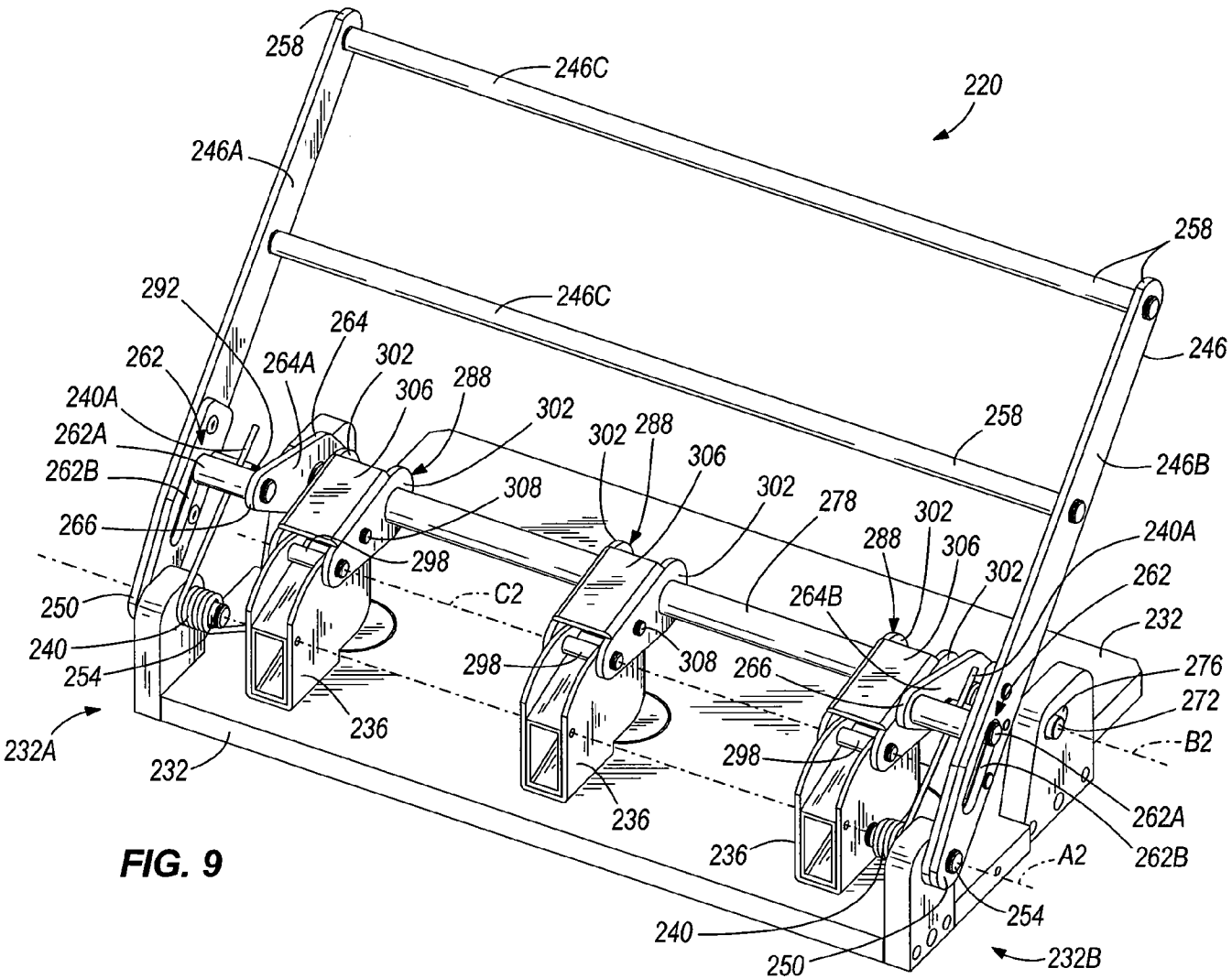
FIG. 9 is another perspective view of the paper processing tool of FIG. 8.
Figure 10:
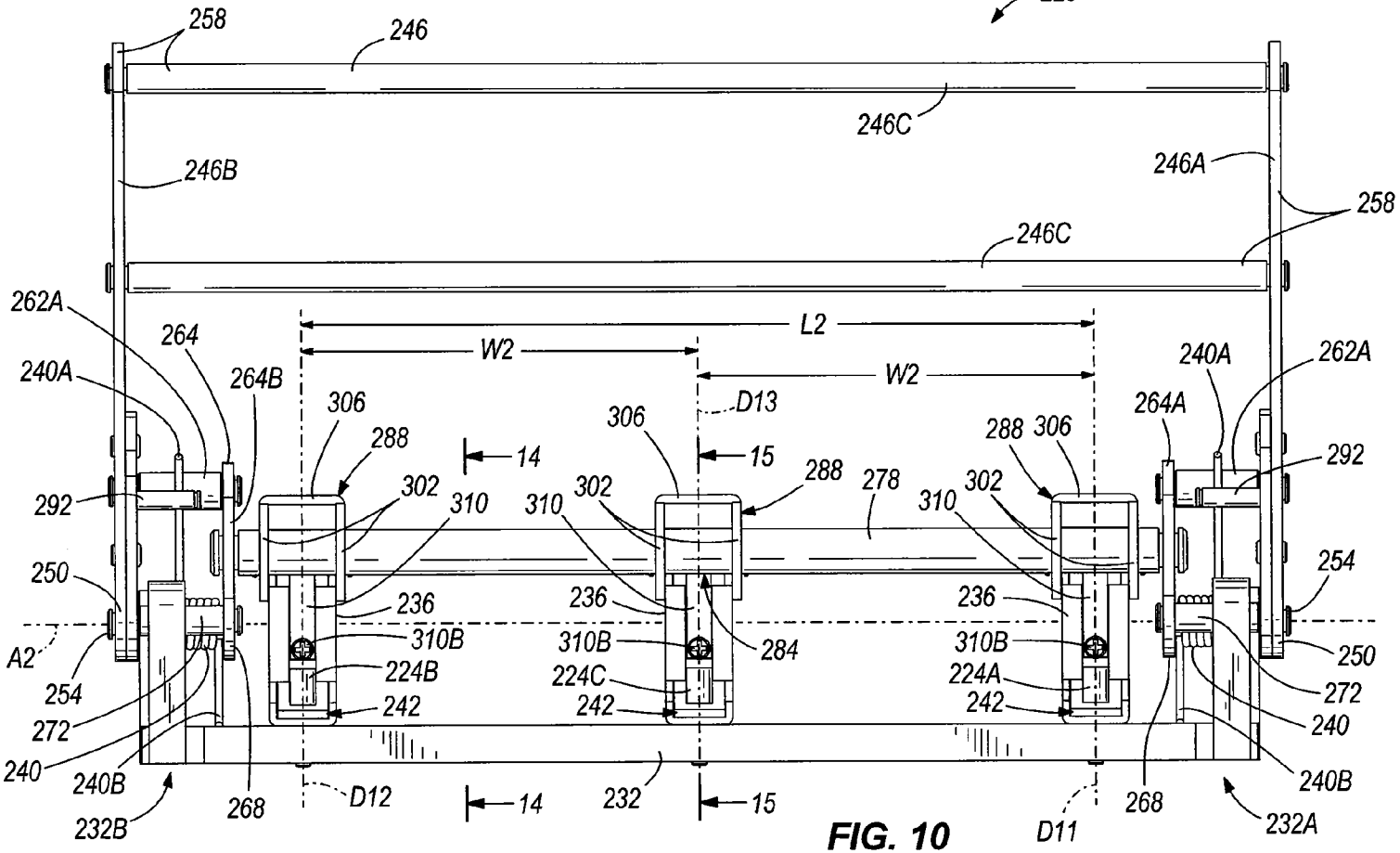
FIG. 10 is a front view of the paper processing tool of FIG. 8.
Figure 11:
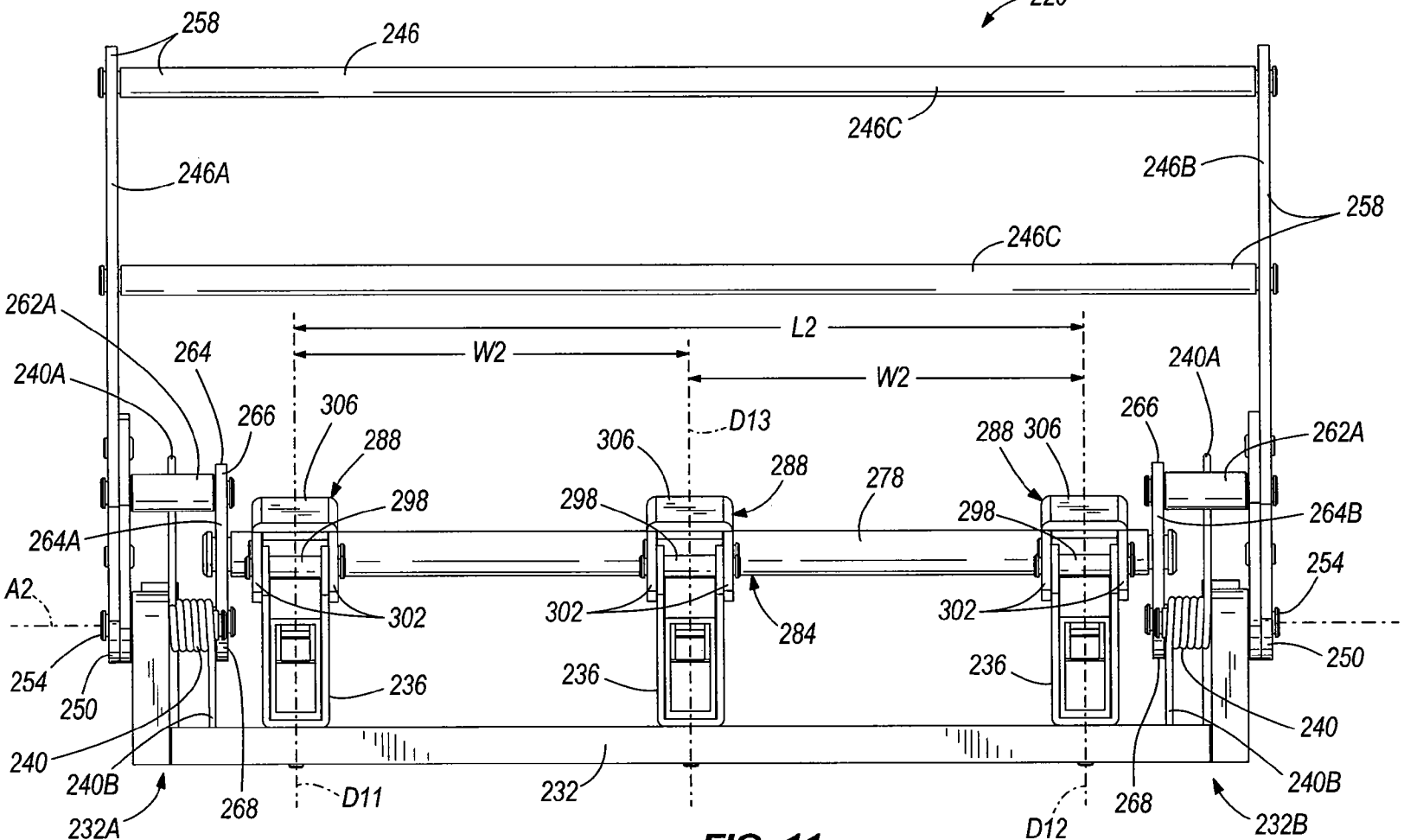
FIG. 11 is a rear view of the paper processing tool of FIG. 8.
Figure 12:
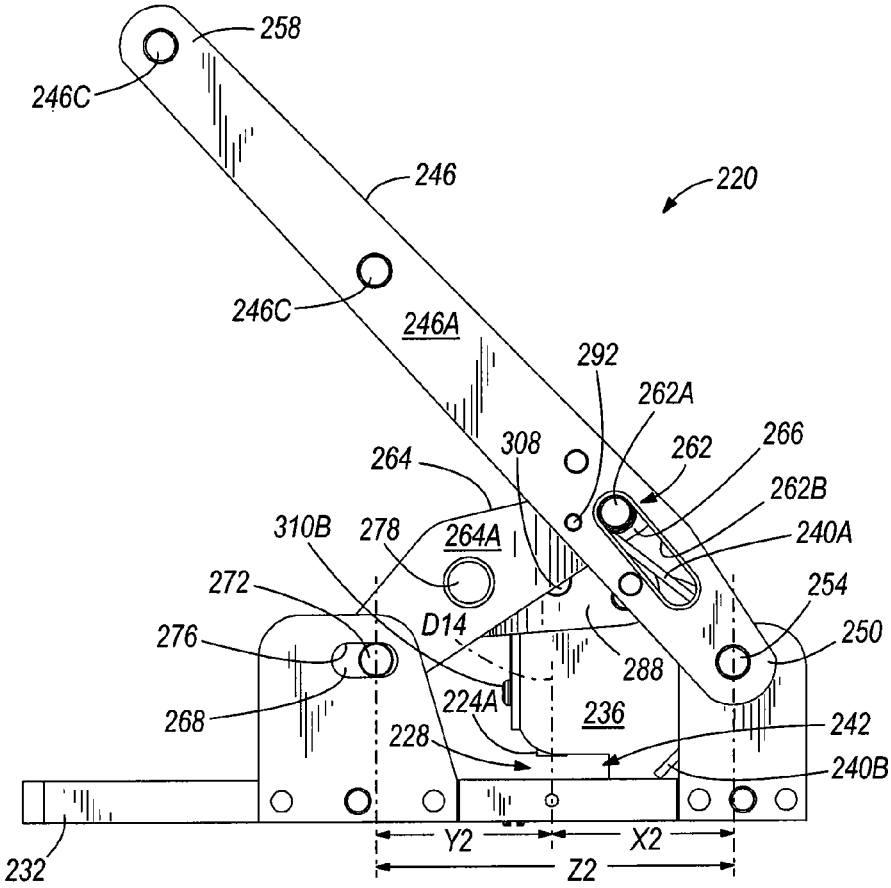
FIG. 12 is a side view of the paper processing tool of FIG. 8.
Figure 13:
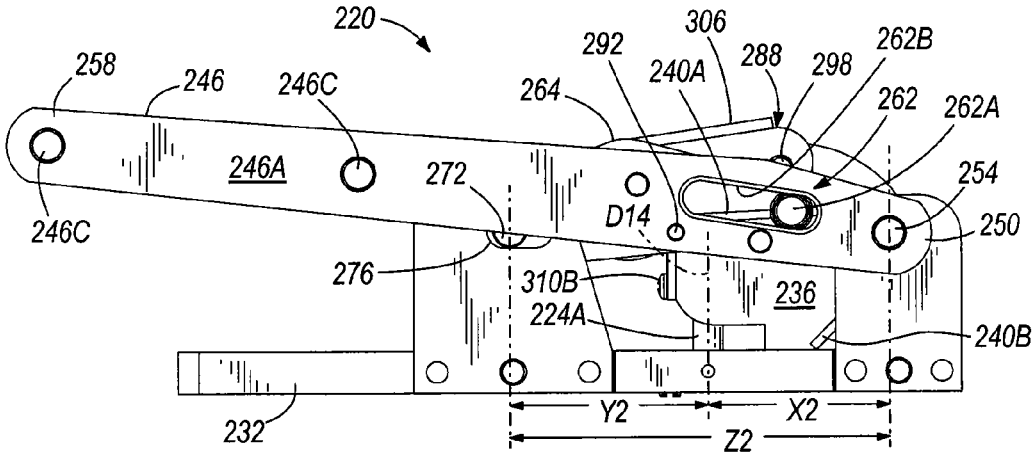
FIG. 13 is a side view of the paper processing tool of FIG. 8 in an actuated operating condition.
Figure 14:
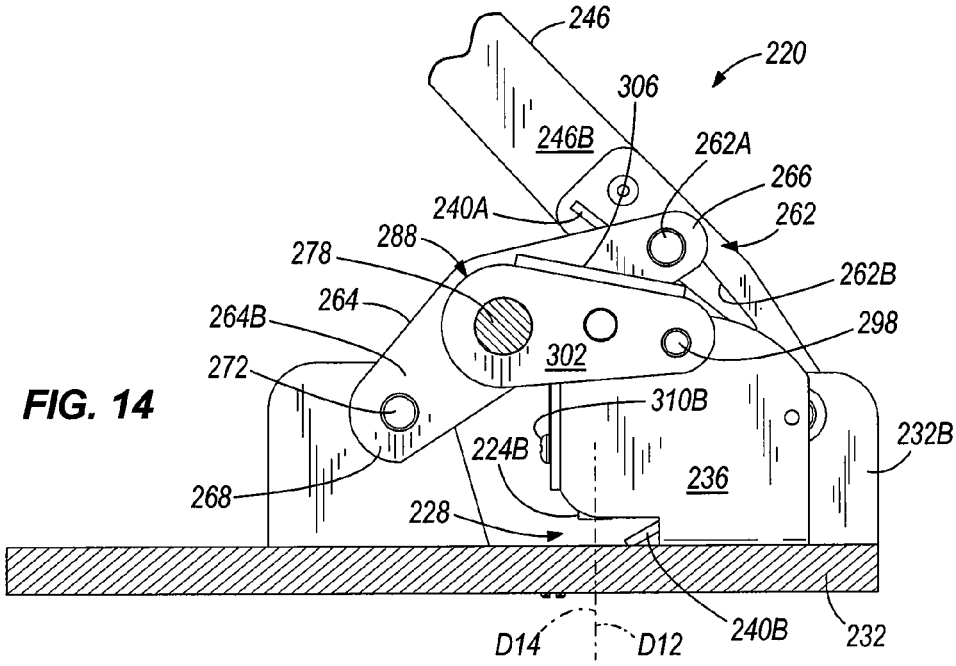
FIG. 14 is a cross-section view of the paper processing tool of FIG. 8, taken along line 14-14 of FIG. 10.
Figure 15:
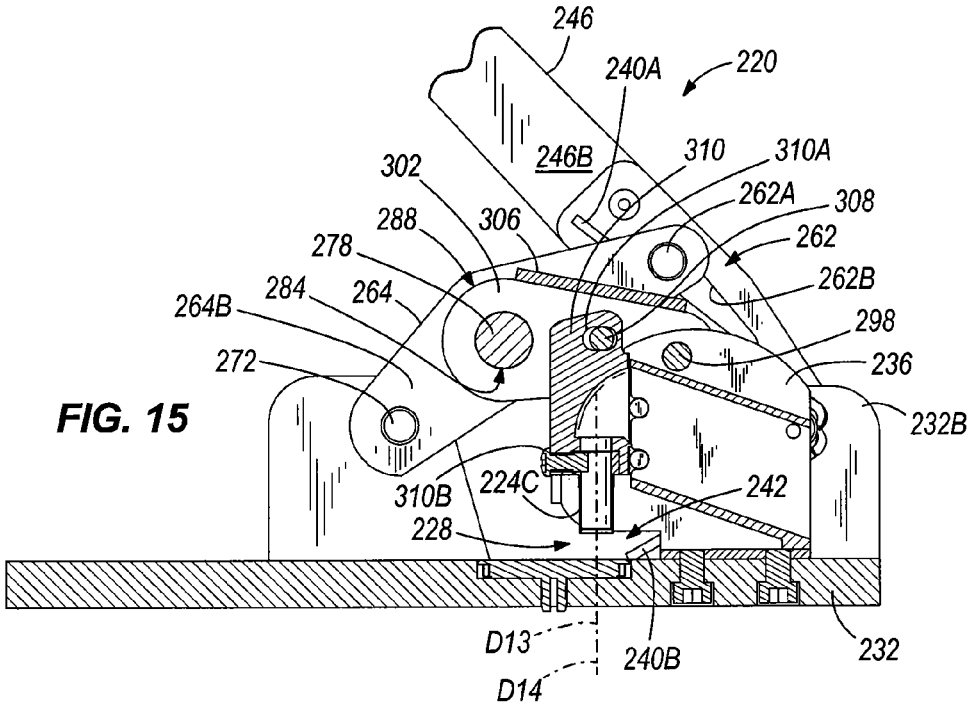
FIG. 15 is a cross-section view of the paper processing tool of FIG. 8, taken along line 15-15 of FIG. 10.
Figure 16:
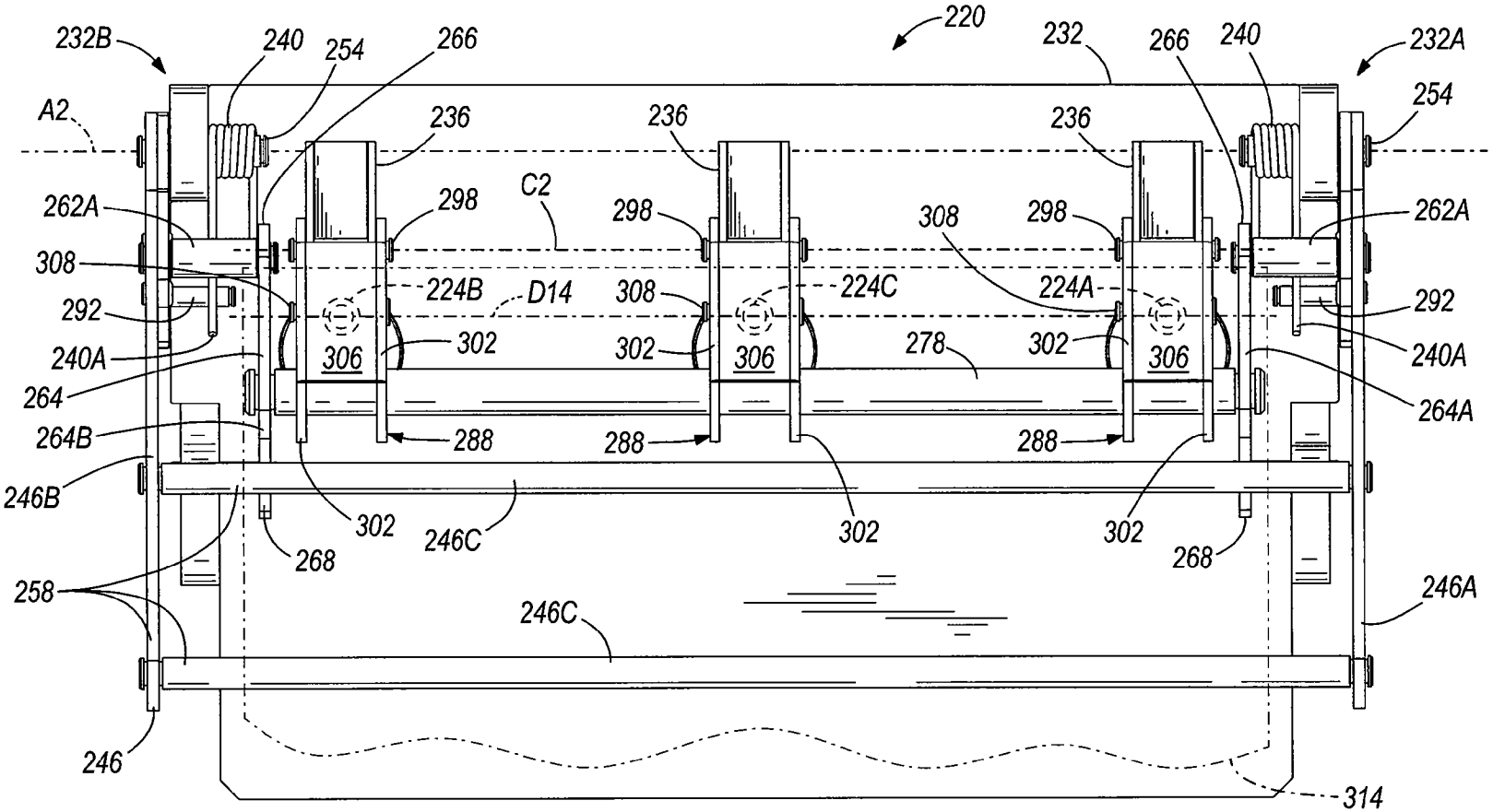
FIG. 16 is a top view of the paper processing tool of FIG. 8, having a sheet object inserted therein.

Furthermore, and as shown in FIGS. 4 and 7, the punch pins 24A-C define a cutting length L (from the first punch pin 24A to the second punch pin 24B). As illustrated, the cutting length L is equal to twice the spacing distance W. In other embodiments, the cutting length L may be defined by the overall or cumulative length of a continuous blade or alternate configurations of spaced apart cutting elements. The first axis A is spaced apart from the second axis B by a distance Z (FIGS. 1 and 7) equal to between about 35 percent and about 115 percent of the cutting length L. In the illustrated embodiment, the distance Z between the first axis A and the second axis B is equal to about 100 percent of the cutting length L.

A paper processing tool 220 according to another embodiment of the invention is illustrated in FIGS. 8-15. The paper processing tool 220 is operable to perform an operation on one or more sheets of paper. The illustrated paper processing tool 220 is a three-hole punch having a set of punch pins 224A, 224B, 224C positioned adjacent a sheet insertion area 228 and spaced equal distances W2 apart. Thus, an overall cutting length L2 is defined between the first punch pin 224A and the second punch pin 224B that is equal to twice the spacing distance W2. The paper processing tool 220 may alternately take the form of another type of apparatus for punching (having more or less than three punch pins), trimming, cutting, etc. In a punching apparatus, tool elements may be similar to the punch pins 224A-C shown, and in other types of apparatuses, alternate types of tool elements may be provided. In the illustrated embodiment, the paper processing tool 220 is particularly adapted for manual operation by a human hand. In other embodiments, the paper processing tool 220 may be configured for automated actuation.

The paper processing tool 220 includes a base 232 having a first end 232A and a second end 232B opposite the first end 232A. Each of the punch pins 224A-C is supported for reciprocable movement relative to the base 232 along a respective axis D11, D12, D13. The punch pins 224A-C are substantially aligned, such that a cutting plane D14 (FIGS. 12-16) contains each of the punch pin axes D11, D12, D13. The base 232 includes a punch frame or housing 236 for each punch pin 224A-C which mounts the punch pins 224A-C to the base 232 and guides the movement of the punch pins 224A-C. One or more of the punch frames 236 may be movable within the cutting plane D14 to change the spacing between the punch pins 224A-C. Each punch frame 236 defines an insertion slot 242 positioned along the sheet insertion area 228. One or more biasing elements 240 bias the punch pins 224A-C generally upward out of the insertion slots 242 as described in further detail below.

The paper processing tool 220 further includes a first lever 246. The first lever 246 includes a first link 246A, a second link 246B, and a pair of connecting links 246C extending between the first link 246A and the second link 246B. The first lever 246 is an input member of the paper processing tool 220 and as such, is configured to receive an input force incident on the paper processing tool 220. The first and second links 246A, 246B of the first lever 246 are substantially identical mirror images of one another and each includes an attachment portion 250 mounted to the base 232. The entire first lever 246 is pivotable relative to the base 232 about a first axis A2. The first axis A2 is defined by an axle or pin 254 engaged with each attachment portion 250. The first axis A2 is further defined by two pairs of coaxial holes, one hole through each attachment portion 250 and one hole through the base 232 immediately adjacent each attachment portion 250. The first lever 246 includes a handle portion 258 remote from the attachment portion 250 and the first axis A2. The handle portion 258 is configured to receive a manual input from a user's hand, although the first lever 246 may be actuated in an automated manner in some embodiments. In the illustrated embodiment, the handle portion 258 includes the connecting links 246C and portions of both the first and second links 246A, 246B (opposite the attachment portions 250).

One or more sliding joints 262 are provided between the first lever 246 and an intermediate lever 264. In the illustrated embodiment, both the first and second links 246A, 246B of the first lever 246 are coupled to the intermediate lever 264 via sliding joints 262. Similar to the first lever 246, the intermediate lever 264 includes a pair of spaced-apart, parallel links. The intermediate lever 264 includes a first link 264A and a second link 264B. The first and second links 264A, 264B are coupled together as described in further detail below.

Each sliding joint 262 includes a pin 262A movable with the corresponding intermediate lever 264 and a slot 262B in the corresponding link 246A, 246B of the first lever 246. The sliding joints 262 are located adjacent the attachment portions 250 on the first and second links 246A, 246B of the first lever 246. On the intermediate lever 264, the sliding joints 262 are located adjacent a first end 266 of each of the links 264A, 264B, which is opposite a second end 268 of each of the links 264A, 264B of the intermediate lever 264 where the intermediate lever 264 is coupled to the base 232. The intermediate lever 264 is pivotable relative to the base 232 about a second axis B2. The second axis B2 is defined by an axle or pin 272 engaged with the second ends 268 of the first and second links 264A, 264B and by coaxial holes in the second ends 268 and axially aligned slots 276 in the base 232. The intermediate lever 264 is a transmission member configured to receive a force from the first lever 246 and transmit an equal or greater force to the punch pins 224A-C through at least one additional transmission member.

The intermediate lever 264 includes not only the first and second links 264A, 264B, but also a drive member such as a drive pin 278 extending between the first and second links 264A, 264B at a location between the respective first and second ends 266, 268. In the illustrated embodiment, the drive pin 278 is substantially centered between the first and second ends 266, 268 of each of the first and second links 264A, 264B of the intermediate lever 264. The drive pin 278 includes a rounded or cylindrical drive surface 284 configured to engage one or more drive levers 288. In some embodiments, the drive pin 278 may include a roller similar to the roller 78A of the paper processing tool 20 illustrated in FIGS. 1-7.

In the illustrated embodiment, three drive levers 288 are actuable by the drive pin 278. In the illustrated embodiment, each drive lever 288 is coupled to a respective one of the punch frames 236. The drive levers 288 are pivotably coupled to the punch frames 236 (and thus, relative to the base 232) by respective pins 298. The pins 298 define a third axis C2 about which the drive levers 288 are pivotable relative to the base 232. The third axis C2 is substantially parallel to both of the first and second axes A2, B2. The third axis C2 is also substantially parallel to the cutting plane D14. The drive levers 288 are configured to engage and actuate the punch pins 224A-C as described in further detail below.

As shown in FIGS. 8-11, each of the drive levers 288 includes a pair of flange portions 302 and a connecting portion 306, each of the flange portions 302 having an opening formed therein to receive the drive pin 278. The drive pin 278 is engaged with the drive levers to rotate the drive levers 288 about the third axis C2 and reciprocate the punch pins 224A-C along their respective axes D11, D12, D13 within the cutting plane D14. A secondary drive pin 308 extends between each pair of flange portions 302. The punch pins 224A-C are mounted to respective punch blocks 310 (FIG. 15), each of which includes a slot 310A in which one of the secondary drive pins 308 is engaged. The punch pins 224A-C are directly connected to the punch blocks 310 (in the sense that each punch pin 224A-C is fixed relative to the respective punch block 310). In the illustrated embodiment, a single set screw 310B couples the punch pins 224A-C to the respective punch blocks 310. All three of the drive levers 288 are actuated by the drive pin 278 so that the drive levers 288 actuate all three punch pins 224A-C for synchronized movement of the punch pins 224A-C (within the cutting plane D14) towards and into engagement with a sheet object 314 in the insertion area 228. In some embodiments, the drive levers 288 actuate the punch pins 224A-C sequentially.

In other embodiments, more or fewer than three punch pins similar to the punch pins 224A-C are provided, and one or more drive levers 288 engage the punch pins 224A-C for synchronized movement thereof. In yet other embodiments, the paper processing tool 220 is provided with one or more alternate tool elements (see FIGS. 17-19) instead of the punch pins 224A-C as illustrated in FIGS. 8-16.

In operation, the sheet object 314 to be processed (e.g., cut, trimmed, punched) is inserted into the insertion area 228 along an insertion direction perpendicular to the cutting plane D14. A force is then applied to the handle portion 258 of the first lever 246. The first lever 246 rotates relative to the base 232 about the first axis A2. The springs 240 are torsion springs in the illustrated embodiment and each spring 240 is wound around a respective one of the pins 254 connecting the first lever 246 to the base 232. An extending leg 240A of each spring 240 rests against the adjacent sliding joint pin 262A and also upon a pin 292 extending from an interior side of the adjacent link 246A, 246B such that the extending leg 240A is trapped between the pins 262A, 292. An opposite extending leg 240B of each of the springs 240 rests against the base 232 such that rotation of the first lever 246 (moving the handle portion 258 towards the base 232) loads the springs 240. The springs 240 are sufficient to hold the first lever 246 in the fully inoperative or "up" position (see FIG. 12, for example) at rest, but is easily overcome by the user to operate the paper processing tool 220.

The force applied to the first lever 246 is multiplied as it is transferred to the intermediate lever 264 via the sliding joints 262. During transfer between the first lever 246 and the intermediate lever 264, the handle portion 258 moves towards the base 232 and the pins 262A slide within the slots 262B. As the pins 262A slide in the slots 262B toward the first axis A2, the mechanical advantage or force multiplication between the first lever 246 and the intermediate lever 264 is increased due to the increased lever arm distance between the handle portion 258 and the axis of the pins 262A. The sliding joints 262 provide a variable mechanical advantage by allowing the point of contact between the first lever 246 and the intermediate lever 264 (defined by the point on the slot 262B that is in driving contact with the pin 262A) to move relative to the first axis A2.

As force is transmitted from the first lever 246 to the intermediate lever 264 through the sliding joints 262, the first end 266 of the intermediate lever 264 moves towards the base 232 as the intermediate lever 264 rotates about the second axis B2. The drive pin 278 moves towards the base 232 such that the drive surface 284 engages the drive levers 288. As the intermediate lever 264 rotates about the second axis B2, the drive pin 278 drives the drive levers 288 to rotate about the third axis C2. The generally downward (towards the base 232) rotation of the drive levers 288 causes some amount of sliding contact between the cylindrical drive surface 284 of the drive pin 278 and the openings in the drive levers 288. Alternately or in addition, the drive pin 278 can rotate with the drive levers 288, and some amount of sliding may occur between the drive pin 278 and each of the first and second links 264A, 264B of the intermediate lever 264. In some embodiments, rolling contact occurs between the drive pin 278 and the drive levers 288 and/or between the drive pin 278 and the intermediate lever 264, for example by one or more roller bearings or other rolling elements (not shown).

As the drive levers 288 rotate towards the base 232 under force from the intermediate lever 264, the secondary drive pins 308 exert a downward force upon the slots 310A in each of the punch blocks 310 to drive the punch pins 224A-C along their respective axes D11, D12, D13. The slots 310A allow the secondary drive pins 308 to slide relative to the punch blocks 310, which is necessary to have both pivotal movement of the drive levers 288 and reciprocal movement of the punch blocks 310 and the punch pins 224A-C. In the illustrated embodiment, the punch pins 224A-C are actuated synchronously from fully inoperative positions (FIG. 12) outside of the insertion slots 242 to fully operative positions (FIG. 13) in which the punch pins 224A-C extend entirely through the insertion slots 242. In some embodiments, the punch pins 224A-C are actuated asynchronously. The punch pins 224A-C remain in the cutting plane D14 at all times.

In order to generate a large mechanical advantage for performing the desired action on the sheet object 314 within an efficient and small size or "foot print" (i.e., the area of the base 232), the paper processing tool 220 includes a specific arrangement with respect to the levers 246, 264, 288 and the respective axes of rotation A2, B2, C2. The first axis A2 is positioned on one side of the cutting plane D14, and the second axis B2 is positioned on an opposite side of the cutting plane D14. Specifically, the first axis A2 is positioned a distance X2 equal to between about 35 percent and about 45 percent of the distance W2 (i.e., half the cutting length L2) rearward of the cutting plane D14. In the illustrated embodiment, the first axis A2 is positioned a distance X2 equal to about 40 percent of the distance W2 rearward of the cutting plane D14. Furthermore, the second axis B2 is positioned a distance Y2 equal to between about 30 percent and about 45 percent of the distance W2 forward of the cutting plane D14 (in a direction from which the sheet object 314 is inserted). In the illustrated embodiment, the second axis B2 is positioned a distance Y2 equal to about 38 percent of the distance W2 forward of the cutting plane D14. Typically, prior art devices have not located a pivot axis forward of the cutting plane as it presents a restriction in access to the sheet insertion area 228, opting instead to provide a small mechanical advantage or a large footprint area of the device. By locating the second axis B2 forward of the cutting plane D14, the paper processing tool 220 suffers only a slight restriction in accessibility to the sheet insertion area 228 while providing an exceptional mechanical advantage for the small size of the footprint area.

The first axis A2 is a fixed pivot, which is fixed relative to the base 232, and the second axis B2 is a movable axis, which is not fixed relative to the base 232. As mentioned above, the points of contact between the slots 262B and the pins 262A of the sliding joints 262 define a variable, non-fixed pivot that increases the mechanical advantage of the paper processing tool 220 during the downward stroke of the first lever 246. The paper processing tool 220 has a mechanical advantage ratio of at least 15 between the force applied at the first lever 246 and the force applied to the sheet object 314 by the punch pins 224A-C. The particular arrangement illustrated and described above generates a mechanical advantage ratio of about 20 between the force applied at the first lever 246 and the force applied to the sheet object 314 by the punch pins 224A-C.

Furthermore, in the illustrated embodiment, the cutting length L2 (from the first punch pin 224A to the second punch pin 224B) is equal to twice the spacing distance W2. In other embodiments, the cutting length L2 may be defined by the overall or cumulative length of a continuous blade or alternate configurations of spaced apart cutting elements. The first axis A2 is spaced apart from the second axis B2 by a distance Z2 equal to between about 35 percent and about 115 percent of the cutting length L2. In the illustrated embodiment, the distance Z2 between the first axis A2 and the second axis B2 is equal to about 40 percent of the cutting length L2.

Figure 17:
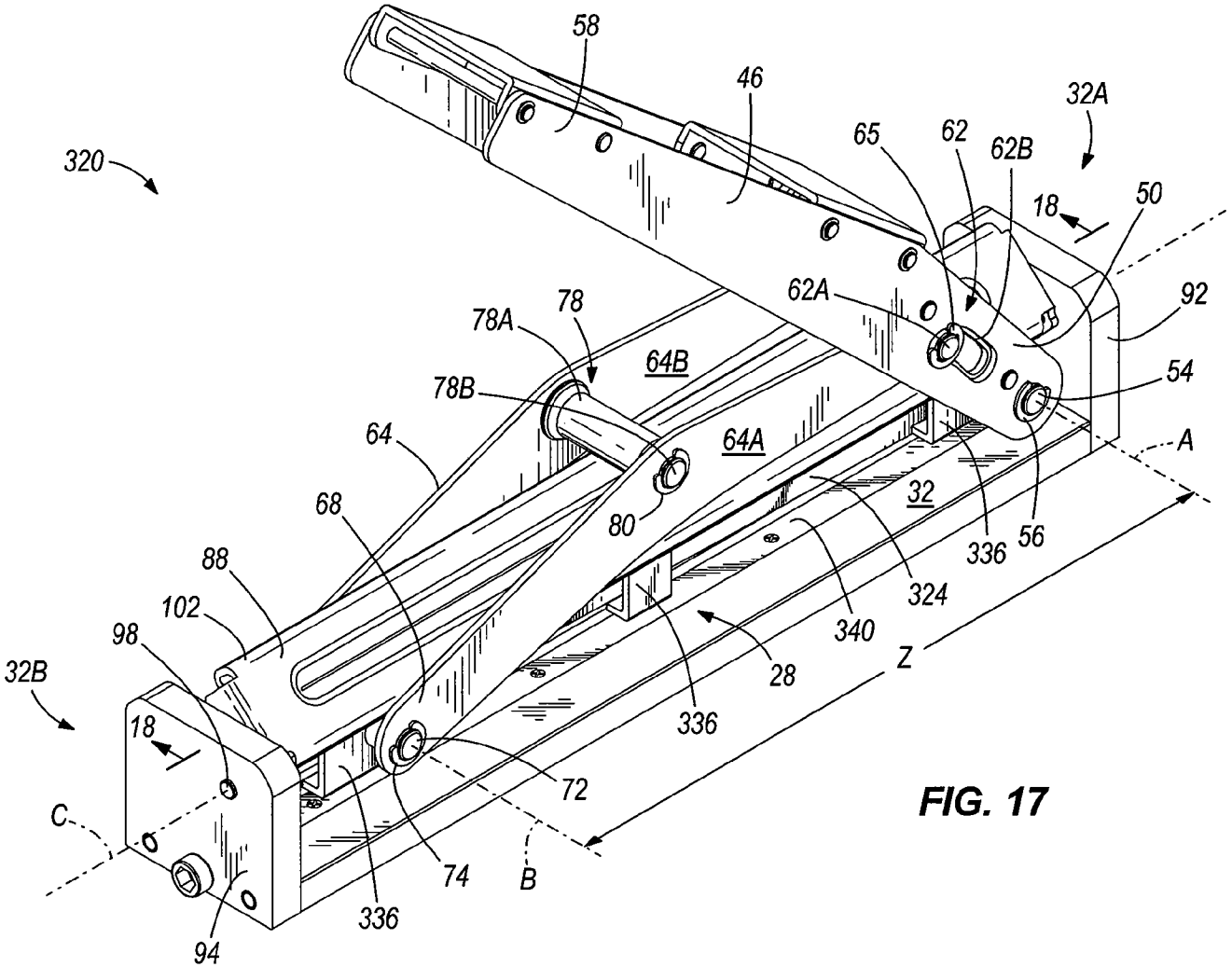
FIG. 17 is a perspective view of a paper processing tool similar to the tool shown in FIGS. 1-7 having an alternate tool element.
Figure 18:
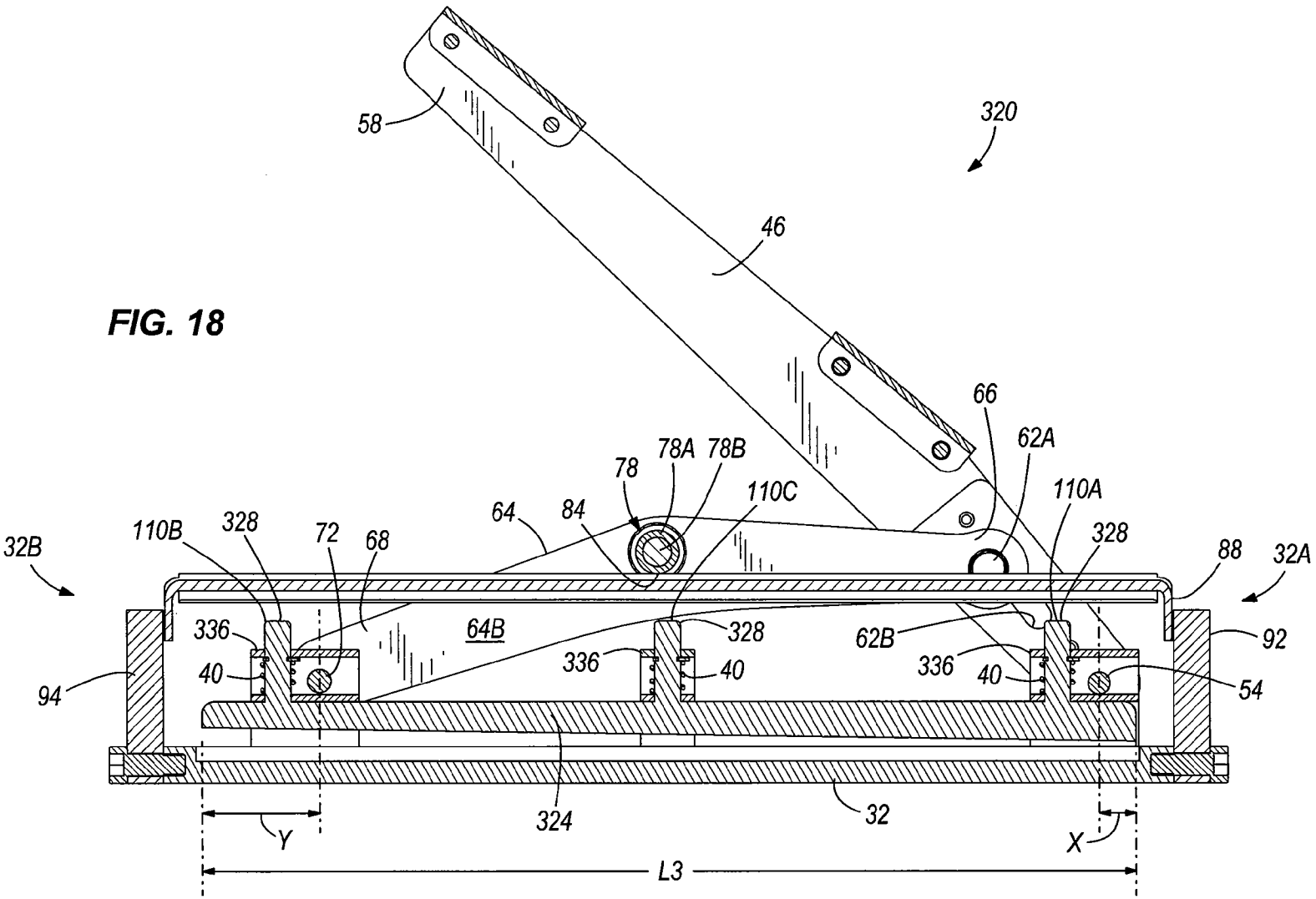
FIG. 18 is a cross-section view of the paper processing tool of FIG. 17, taken along line 18-18 of FIG. 17.

FIGS. 17-18 illustrate a paper processing tool 320 similar in many aspects to the tool 20 illustrated in FIGS. 1-7. Like reference characters are used where applicable. However, in place of the punch pins 24A-C, the paper processing tool 320 of FIGS. 17-18 includes a trimmer blade 324 arranged along the cutting plane D4 (not shown). The trimmer blade 324 has a cutting length L3 and is actuated to reciprocate in the same manner as described above with reference to the punch pins 24A-C of the paper processing tool 20. For example, the drive lever 88 actuates upper surfaces 110A-C of respective mounting blocks or blade extensions 328. Trimmer guide frames 336 are slotted to allow passage of the trimmer blade 324 therethrough. The trimmer blade 324 is angled (i.e., non-parallel) with respect to the horizontal base 32 and interacts with a lower stationary blade 340 to shear sheet material when the first lever 46 is depressed.

The geometry and function of the first lever 46, the intermediate lever 64, the sliding joint 62, and the drive lever 88 is unchanged from the paper processing tool 20 of FIGS. 1-7, and thus, the same advantages are provided. Although the cutting length L3 of the trimmer blade 324 is illustrated as being relatively longer than the cutting length L of the paper processing tool 20 of FIGS. 1-7, it should be noted that the cutting length L3 may be longer or shorter than shown in FIG. 18. For example, the cutting length L3 can be substantially equal to the cutting length L of the paper processing tool 20 of FIGS. 1-7 such that the ratios relating the distances X, Y, and Z thereto are substantially the same as described above with respect to the paper processing tool 20 of FIGS. 1-7. Where dimensions are related to the spacing distance W, it is understood that they may be considered as being related to one half of the cutting length L or L3.

Thus, the invention provides, among other things, a compact paper processing tool with a large mechanical advantage, which includes a first lever, an intermediate lever, and a drive lever. Each lever rotates relative to the base about a separate axis, and the axis of the drive lever is parallel to a cutting plane of the paper processing tool. Various features and advantages of the invention are set forth in the following claims.

What is claimed is:

1. A paper processing tool comprising:

a base having a receiving area for selectively receiving a sheet of paper;

a first lever having a handle portion, the first lever being pivotable about a first axis that is fixed relative to the base;

an intermediate lever being pivotable relative to the base about a second axis in response to movement of the first lever;

at least one cutting element arranged along a cutting plane, the at least one cutting element being configured to selectively engage the sheet of paper; and a drive lever pivotable about a third axis that is fixed relative to the base, the third axis being parallel to the cutting plane, wherein pivoting of the first lever about the first axis drives the intermediate lever to pivot about the second axis, pivoting of the intermediate lever about the second axis drives the drive lever to pivot about the third axis, and pivoting of the drive lever about the third axis drives the at least one cutting element to move relative to the base, and wherein the first axis and the second axis are substantially parallel, and the third axis is substantially perpendicular to the first axis and the second axis.

2. The paper processing tool of claim 1, wherein the first lever and the intermediate lever are coupled with a sliding joint that moves along the first lever towards the first axis to increase the mechanical advantage of the first lever as the handle portion moves toward the base.

3. The paper processing tool of claim 2, wherein the sliding joint includes a slot in the first lever and a pin of the intermediate lever.

4. The paper processing tool of claim 1, wherein the at least one cutting element includes two or more punch pins.

5. The paper processing tool of claim 4, wherein the at least one cutting element includes three punch pins being substantially aligned along the cutting plane, the three punch pins being equally spaced apart by a spacing distance.

6. The paper processing tool of claim 5, wherein the first axis is positioned not more than 20 percent of the spacing distance away from one of the three punch pins that is closest to a first end of the base.

7. The paper processing tool of claim 5, wherein the second axis is positioned not more than 15 percent of the spacing distance away from one of the three punch pins closest to a second end of the base.

8. The paper processing tool of claim 1, wherein the at least one cutting element includes a substantially planar blade.

9. The paper processing tool of claim 1, wherein the intermediate lever includes a drive member and the drive lever includes a first cam surface engageable by the drive member.

10. The paper processing tool of claim 9, wherein the drive lever includes a second cam surface engageable with the at least one cutting element.

11. The paper processing tool of claim 1, wherein the at least one cutting element defines a cutting length along the cutting plane.

12. The paper processing tool of claim 11, wherein the distance between the first axis and the second axis is between about 35 percent and about 115 percent of the cutting length.

* * * * *